US009889368B1

(12) United States Patent
Chen

(10) Patent No.: US 9,889,368 B1
(45) Date of Patent: Feb. 13, 2018

(54) PERSONAL TRANSPORTATION DEVICE

(71) Applicant: Shane Chen, Camas, WA (US)

(72) Inventor: Shane Chen, Camas, WA (US)

( * ) Notice: Subject to any disclaimer, the term of this patent is extended or adjusted under 35 U.S.C. 154(b) by 0 days.

(21) Appl. No.: 15/256,504

(22) Filed: Sep. 2, 2016

(51) Int. Cl.

| | |
|---|---|
| ***B62M 1/00*** | (2010.01) |
| ***A63C 17/04*** | (2006.01) |
| ***A63C 17/00*** | (2006.01) |
| ***A63C 17/26*** | (2006.01) |
| ***A63C 17/06*** | (2006.01) |

(52) U.S. Cl.
CPC ..... *A63C 17/045* (2013.01); *A63C 17/0033* (2013.01); *A63C 17/0093* (2013.01); *A63C 17/064* (2013.01); *A63C 17/262* (2013.01); *A63C 17/265* (2013.01)

(58) Field of Classification Search
CPC ..... B62K 3/002; A63C 5/16
USPC ..... 280/87.041, 818, 842
See application file for complete search history.

(56) References Cited

U.S. PATENT DOCUMENTS 2,545,543 A * 3/1951 Bottrill ..... A63C 5/035 280/11.204
2,819,907 A * 1/1958 Thoresen ..... A63C 5/035 280/606
3,436,088 A * 4/1969 Kunselman ..... A63C 5/035 280/14.21
3,827,706 A * 8/1974 Milliman ..... A63C 5/035 280/842
3,856,321 A * 12/1974 Solymosi ..... A63C 17/0033 280/842
4,065,146 A * 12/1977 Denzer ..... B62K 3/002 280/221
4,087,104 A * 5/1978 Winchell ..... B62B 13/12 280/12.1
4,123,079 A * 10/1978 Biskup ..... B62K 9/02 280/11.28
4,133,546 A * 1/1979 Rosenblum ..... A63C 5/035 280/842
4,134,600 A * 1/1979 McDonald ..... A63C 5/035 280/11.28
4,165,093 A * 8/1979 Biskup ..... B62K 9/02 280/220
4,353,566 A * 10/1982 Mohlenbrock ..... A63C 17/01 280/11.28
4,363,495 A * 12/1982 Henson ..... A63C 5/06 280/14.28
4,460,187 A * 7/1984 Shimizu ..... A63C 5/035 280/11.208
4,540,192 A * 9/1985 Shelton ..... B62K 3/002 280/220
5,039,121 A * 8/1991 Holter ..... B62K 5/02 280/220
5,785,331 A * 7/1998 Rappaport ..... B62K 3/002 280/87.041

(Continued)

*Primary Examiner* — Jeffrey J Restifo
(74) *Attorney, Agent, or Firm* — Steven J. Sullivan

(57) ABSTRACT

A personal transportation device having first and second elongated foot support member that are arranged substantially in parallel and approximate to some extent the experience of skiing. The lateral distance of the foot support members may be adjusted. Biased-direction caster wheels may be provided that permit propulsion from side to side movement as well as kicking off and other propulsion techniques. Tiltable steering assemblies are disclosed that may impart a tilting of a front wheel to achieve turning. Various embodiments are disclosed.

20 Claims, 5 Drawing Sheets

(56) References Cited

U.S. PATENT DOCUMENTS 6,220,612 B1 * 4/2001 Beleski, Jr. ..... B62K 3/002 280/40
6,485,039 B1 * 11/2002 Ming-Fu ..... B62K 3/002 280/282
6,554,302 B1 * 4/2003 Liu ..... B60T 1/04 280/220
6,719,310 B1 * 4/2004 Lin ..... B62M 1/24 280/62
7,086,491 B2 * 8/2006 Matte ..... A61G 5/042 180/21
8,181,975 B2 * 5/2012 Parhar ..... B62K 3/002 280/209
8,505,945 B2 * 8/2013 Chen ..... B62K 3/002 280/220
8,636,288 B2 * 1/2014 Jeon ..... A63C 17/012 280/11.221
8,807,581 B2 * 8/2014 Liao ..... B62K 19/18 280/272
9,592,434 B2 * 3/2017 Slagter ..... A63B 69/18
2002/0050695 A1 * 5/2002 Feng ..... B62K 3/002 280/87.041
2002/0053775 A1 * 5/2002 Feng ..... B62K 3/002 280/87.041
2002/0063406 A1 * 5/2002 Feng ..... B62K 3/002 280/87.041
2004/0032105 A1 * 2/2004 Tsai ..... B62K 3/002 280/87.041
2004/0094925 A1 * 5/2004 Chuang ..... B62K 3/002 280/87.041
2004/0178597 A1 * 9/2004 Tang ..... B62K 3/002 280/87.041
2004/0256821 A1 * 12/2004 Chuang ..... B62K 21/00 280/87.041
2004/0256822 A1 * 12/2004 Chuang ..... B62K 21/00 280/87.041
2005/0001399 A1 * 1/2005 Yeo ..... B62K 3/002 280/87.041
2005/0082778 A1 * 4/2005 Chuang ..... B62M 1/24 280/87.041
2005/0093261 A1 * 5/2005 Liao ..... B62K 3/002 280/87.041
2005/0156396 A1 * 7/2005 Teng ..... B62K 3/002 280/87.041
2005/0212245 A1 * 9/2005 Fernandez ..... B62K 13/00 280/87.041
2008/0179849 A1 * 7/2008 Fan ..... B62K 3/002 280/87.041
2010/0164193 A1 * 7/2010 Abel ..... B62K 3/002 280/87.041
2010/0201094 A1 * 8/2010 Parhar ..... B62K 13/06 280/87.041
2011/0298194 A1 * 12/2011 Sanchez ..... A63C 17/045 280/245
2012/0043733 A1 * 2/2012 Tsai ..... B62K 3/002 280/87.05
2012/0223502 A1 * 9/2012 Chen ..... B62K 5/10 280/221
2014/0117641 A1 * 5/2014 Fan ..... B62M 1/24 280/228
2016/0096578 A1 * 4/2016 Fan ..... B62K 3/002 280/87.041
2016/0229485 A1 * 8/2016 Hadley ..... B62K 5/06

* cited by examiner

PERSONAL TRANSPORTATION DEVICE

CROSS REFERENCE TO RELATED APPLICATIONS

This application claims the benefit of U.S. Provisional Application No. 62/213,108, filed Sep. 2, 2015, entitled Caster Scooter with Laterally Tiltable Steering Handles, and having the same inventor as above.

FIELD OF THE INVENTION

The present invention relates to scooters and scooter like devices and, more specifically, to those that have biased-direction caster wheels and enhance the scooter riding experience.

BACKGROUND OF THE INVENTION

Various manually propelled scooters and scooter like devices exist in the prior art. Some are directed more intentionally towards providing transportation, while others are directed more intentionally towards providing recreation and/or amusement. Many provide both.

A need does exist, however, for scooter devices that are fun and thereby induce physical exercise while also improving one's balance, physical awareness, and self-confidence. This is particularly important for youth.

In at least one embodiment of the present invention, a rider makes movements similar to those made in skiing. Thus, when used this way, the present invention may serve as a trainer for youth, specifically in skiing and generally in fitness and balance and the like.

A need also exists for scooter devices that provide new and different methods of travel and provide new options for athletic training—whether that be for lighter recreational use or more serious athletic competition.

SUMMARY OF THE INVENTION

Accordingly, it is an object of the present invention to provide a personal transportation device that is fun and thereby encourages use and increases physical activity and skill.

It is also an object of the present invention to provide personal transportation device that include biased direction caster wheels and permits kick-based propulsion and side-to-side movement based propulsion.

It is another object of the present invention to provide a personal transportation device that approximates some of the movements or feel of skiing.

These and related objects of the present invention are achieved by use of a personal transportation device having biased-direction caster wheels as described herein.

The attainment of the foregoing and related advantages and features of the invention should be more readily apparent to those skilled in the art, after review of the following more detailed description of the invention taken together with the drawings.

DETAILED DESCRIPTION

Figure 1:
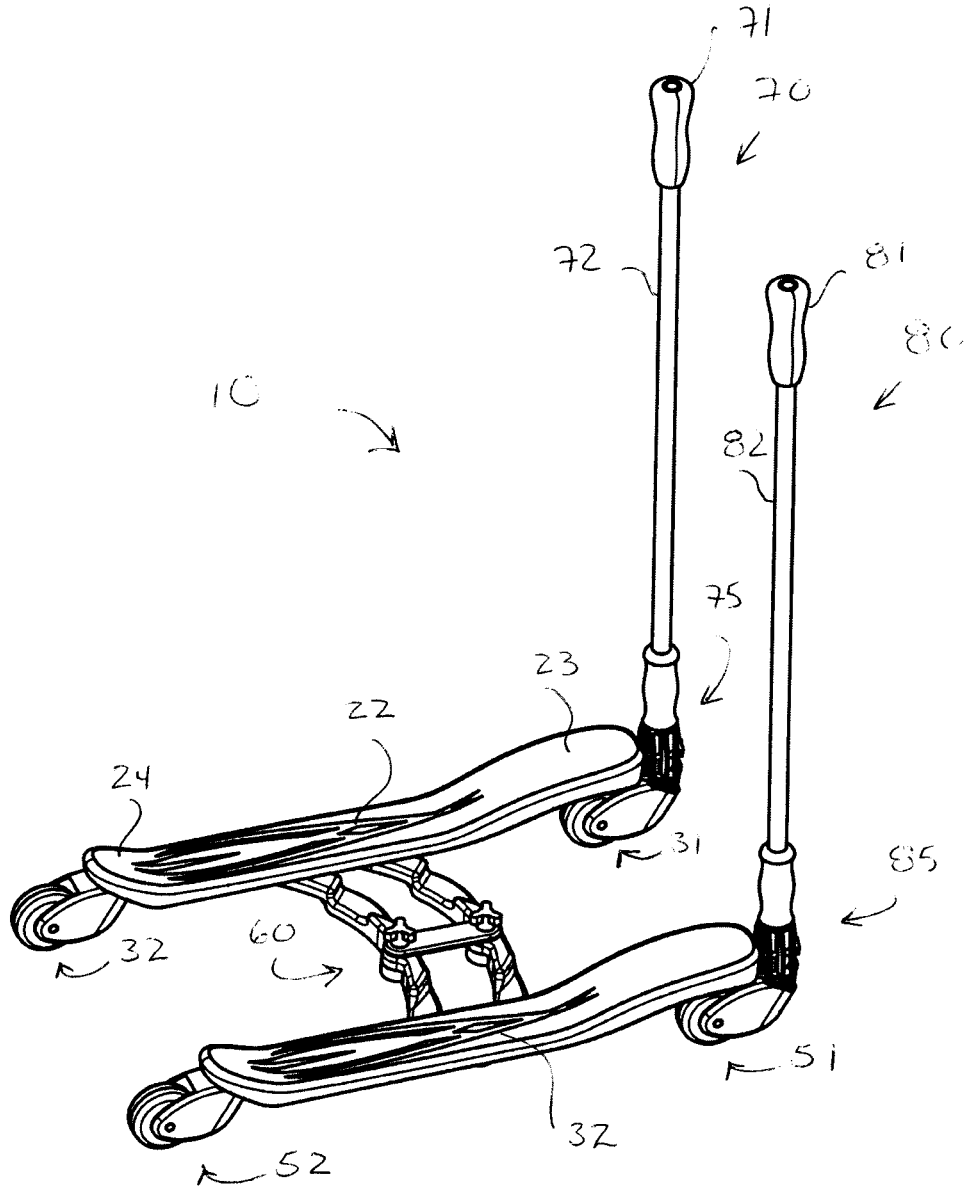
FIG. 1 is perspective view of a personal transportation device in accordance with the present invention.
Figure 2:
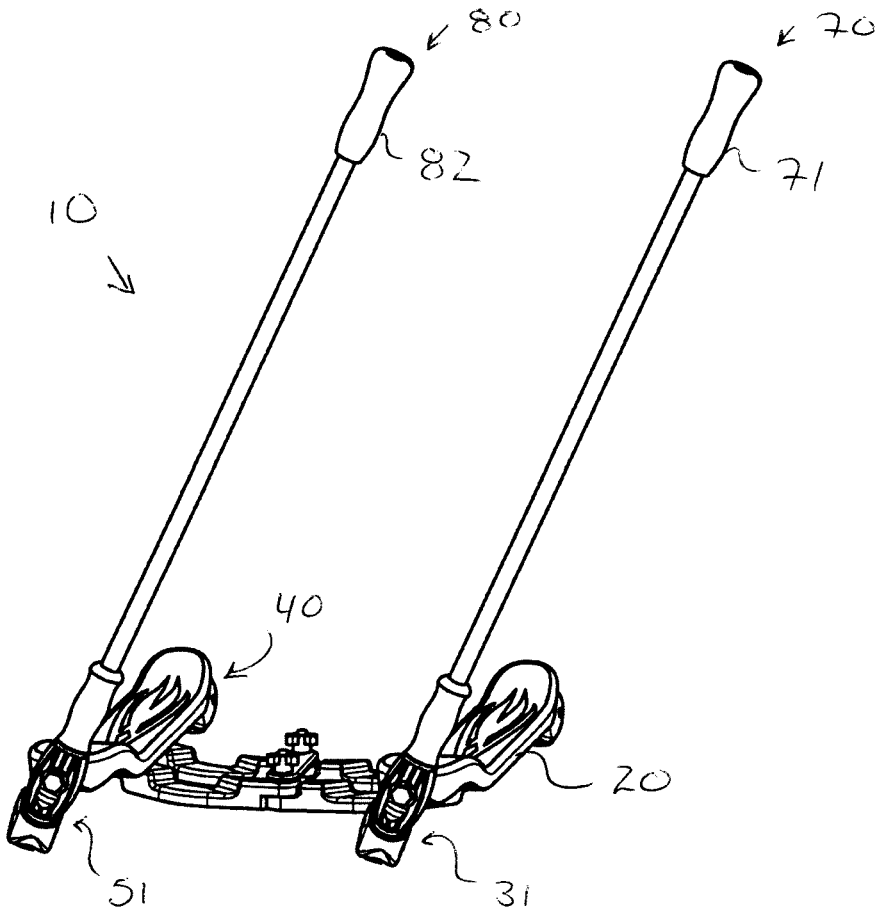
FIG. 2 is a front perspective view of the device of FIG. 1.
Figure 3:
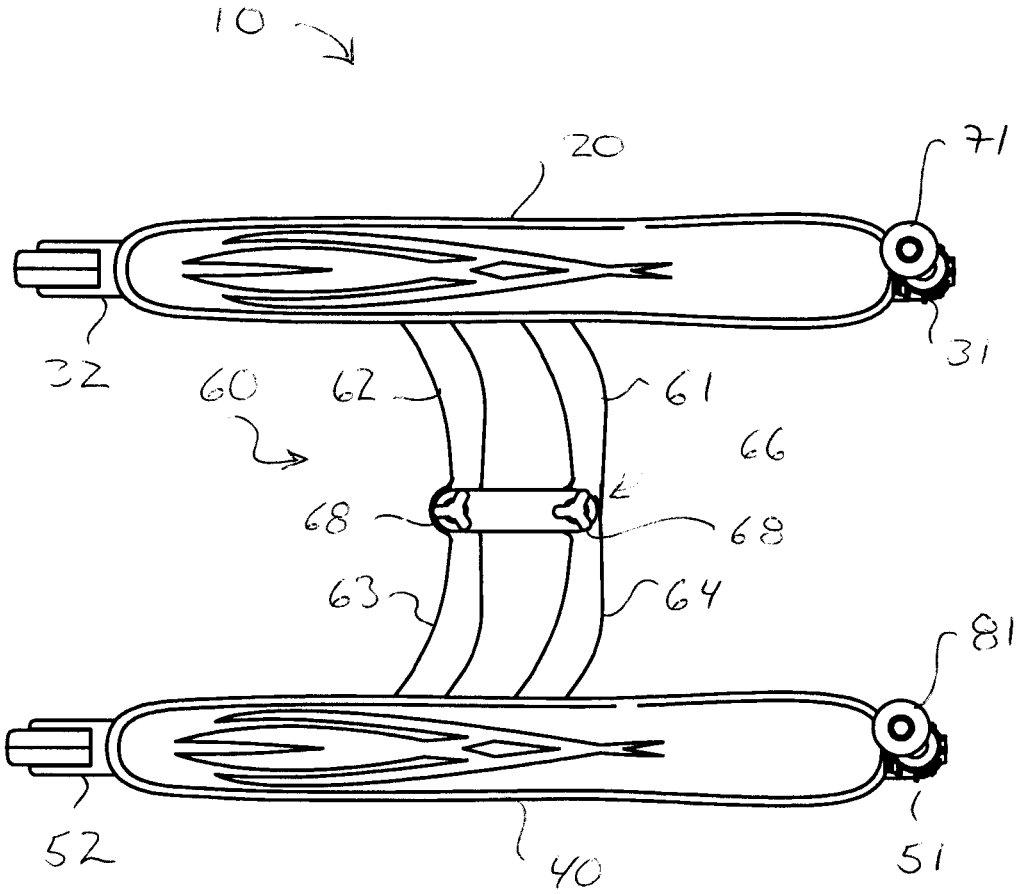
FIG. 3 is a top plan view of the device of FIG. 1.
Figure 4:
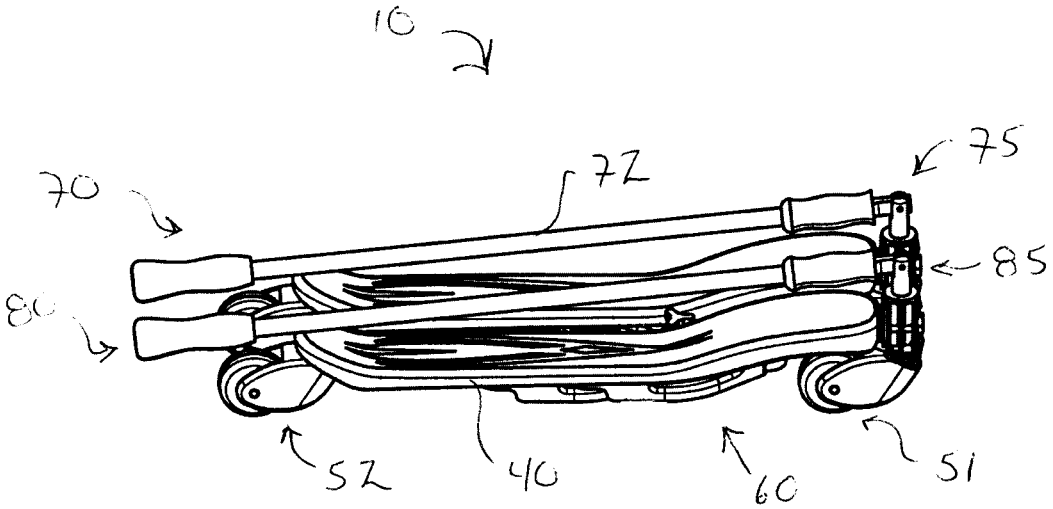
FIG. 4 is a perspective view of the device of FIG. 1 in a stowage position.

Referring to FIGS. 1-3, a side perspective, front perspective, and top plan view of a personal transportation device 10 in accordance with the present invention is shown. FIGS. 1-3 show device 10 in an in-use position while FIG. 4 illustrates device 10 in a stowage position.

Device 10 preferably has two foot support member 20,40 (left and right, respectively, from the perspective of a rider standing on the device), each having a front direction-biased caster wheel 31,51 and a rear direction-biased caster wheel 32,52, respectively. Foot support members 20,40 are preferably maintained in a substantially parallel arrangement by a linkage assembly 60. Linkage mechanism 60 also preferably permits the foot support members to be moved together or apart and be releasably held at various lateral distances from one another within the range of fully extended (FIG. 1) to fully closed (FIG. 4). Left and right handle or steering structures 70,80 are preferably provided forward of each foot support member 20,40, respectively. In use, a rider stands facing forward (towards the handles) with a foot on each foot support member 20,40 and a hand on each handle structure 70,80.

Foot Support Members

The left and right foot support members 20,40 are preferably elongated in the longitudinal or fore-aft axis and have a substantially flat upward-facing surface capable of supporting a human rider's foot. Each foot support members 20,40 may have a foot placement section 22,42 that is substantial flat and configured to receive a foot. In the embodiment of FIGS. 1-2, it can been seen that the support members have a "saddle" shape with front sections 23,43 and rear sections 24,44 extending above their respective foot placement sections 22,42. This may serve to center a rider's foot and also provide a raised member or section adjacent thereto to receive the pivot shaft of the caster assembly.

While a saddle or recess shape is shown, the foot support members may be otherwise shaped, including substantially flat in their entirety or other. The level of the foot placement section may be above the caster wheels, between the top of the wheels and their axis of rotation or below the axis of rotation if the wheels are relatively large.

Referring to FIG. 3, it can be seen that the foot support members 20,40 are longer than wide. In the embodiment of FIG. 4, they are nearly 7 or 8 times longer than wide. The ratio may be greater than this, reaching 9 or 10 times or more greater than wide, or less, such as 6, 5 or 4 or less times longer than wide. FIG. 3 also shows that the front sections 23,43 may be slightly wider than other sections of the support member, hence resembling to some extent a downhill ski.

A heal cup or tread or other item may be place in foot platform section 22,42 to increase friction and/or secure foot placement.

Caster Wheel Assemblies

The wheels assemblies are preferably casters capable of swiveling to face any direction but biased to face forward, i.e., direction-biased casters 31,32,51, 52. The bias may be achieved by various arrangements, including but not limited to, coupling a biasing spring to each caster wheel or mounting the casters at a forward inclined angle relative to the riding surface. These arrangements are known in the art and permit forward propulsion from side-to-side movement.

For example, in addition to scooter-like kicking and other propulsion methods, a rider, by shifting his or her weight can push the foot support members sideways and move the casters towards the line of direction of the weight shift (i.e., away from their neutral forward-facing orientation). Once the sideways force is removed, the casters return to their neutral orientation and the device travels forward. By repeated side to side movement, the device may be propelled forward. Since the two parallel foot support members may resembled skis and quick side to side movement, particularly in a child, may resemble a wiggle, device 10 may affectionately be referred to as "wiggle skis."

Linkage

The linkage assembly 60 is preferably coupled to both foot support members 20,40 and holds them parallel to one another while maintaining a predetermined or selected distance between them. While the linkage assembly may be implemented in any of several different arrangements without deviating from the presenting invention, device 10 of FIGS. 1-3 illustrates four arms 61-64 with arms 61-62 and 63-64 arranged symmetric about a centerline and arms 61 and 63 moving substantially in parallel with arms 62 and 64. The arms are movably coupled to the support members (preferably to a bottom thereof as shown) and to a releasable arm-locking member 66. Knobs or fasteners 68 may be released and the support members 20,40 set a desired spacing, and then re-fastened or locked. In this manner, the support members 20,40 can be set at any lateral spacing allowed by the length of the arms.

Furthermore, device 10 may be moved between the in-use and stowage configurations. In the in-use configuration, the linkage assembly is locked in an expanded position to maintain distance between the foot support members (as shown in FIG. 1-3). Depending on the embodiment, there may be only one lateral width setting, or the linkage assembly can be adjustable to different widths to accommodate riders' varying size and preferences. In the stowage position, the linkage assembly is fully collapsed so that there is no or very little distance between the foot support members, thereby minimizing the overall size.

Note, however, that the device may be ridden with the foot support members arranged next to another, as in FIG. 4 (yet with the handles up). This arrangement would approximate a mono-ski.

Handle Structure

Handle assemblies 70,80 are preferably disposed at the front of each foot support member 20,40, respectively. Each handle assembly 70,80 may include an elongated shaft 72,82 which is generally vertically oriented so that a rider's hands grab a handle or grip 71,81, respectively, provided at a top thereof. The handle assemblies, in the in-use position, are preferably rigid to provide support for the rider. The handle assemblies are preferably connected to their respective front casters so that laterally tilting a handle assembly causes a similar tilt in the corresponding front caster (i.e., on the roll axis), resulting in a turning of device 10. This tilt and turning is shown, for example, in FIG. 2. Each shaft 72,82 may have a basal joint that allows the shaft to be folded rearward and downward toward the foot support members (FIG. 4) to reduce the size of the scooter for stowage or carrying.

In order to keep the shafts rigid in the fore-aft dimension while in the in-use configuration, a locking apparatus may be provided on each shaft. Engaging the locking apparatus locks the shaft in vertical, unfolded position. Disengaging the locking apparatus allows the joint to pivot and the shaft to fold downward. In the embodiment of FIGS. 1-4, the locking apparatus 75,85 may be a tube member encircling the shaft. The tube member is capable of sliding along the shaft to either cover or expose the joint. When the tube member covers the joint the locking apparatus is engaged and the shaft cannot fold. When the tube member is slid upward to expose the joint the locking apparatus is disengaged and the shaft can be folded. Various releasable locking mechanisms for a pivoting joint are known in the art and may be used herein without deviating from the invention.

While two steering assemblies or structures are shown, it should be recognized that device 10 could function with one steering assembly.

Other Embodiments

In another embodiment of device 10 and/or the linkage mechanism therefor, there may be an option for the rider to operate the device while the linkage assembly is partially or wholly unlocked. In this configuration the foot supports could be moved forward and backward relative to each other during use. The parallel arrangement of the support members would preferably be maintained.

Alternatively (or additionally), the linkage assembly could be configured to allow the foot support members to be moved closer and farther apart during use. These configurations would allow additional or enhanced techniques for propulsion and increase maneuverability and the excitement of riding the device, particularly for skilled riders. The handle assemblies may also be made to be partially or wholly unlockable in the fore-and-aft dimension to enhance the riding and use experience.

Figure 5:
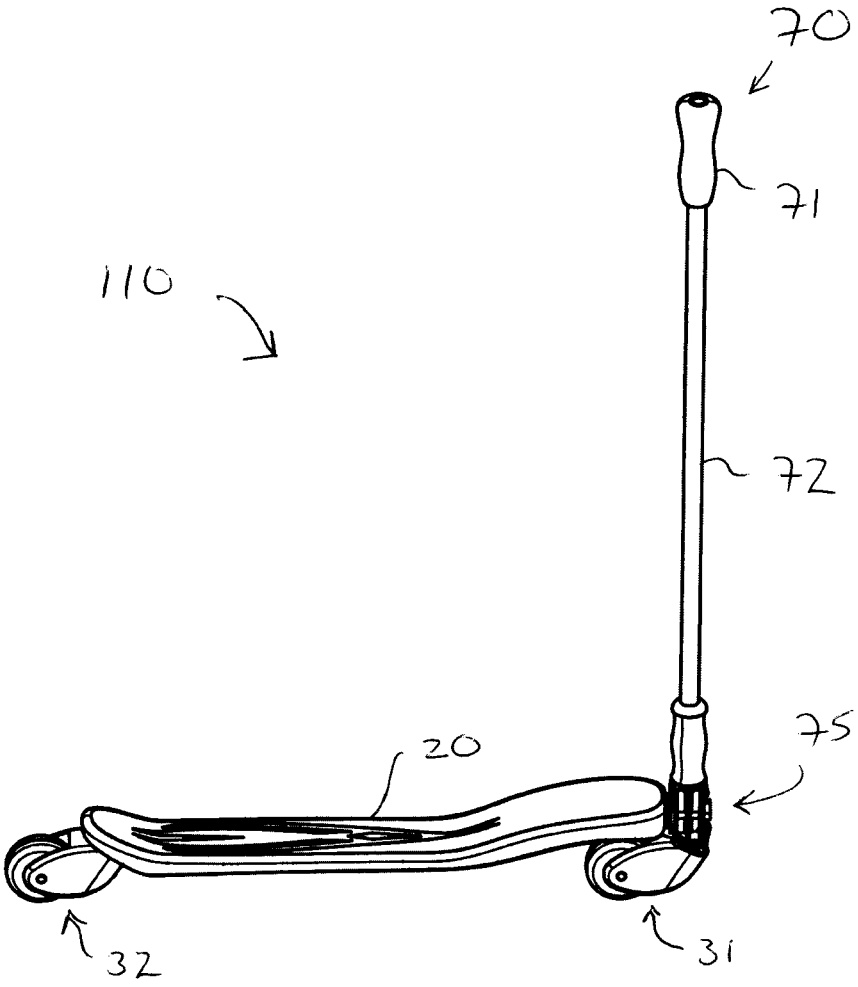
FIG. 5 illustrates another embodiment of the present invention that has a singular foot support member.

Referring to FIG. 5, a side perspective view of another embodiment of a personal transportation device 110 in accordance with the present invention is shown. Device 110 is similar to device 10 discussed above, yet has a single foot support member 120, handle assembly 170, and front and rear biased caster wheels 131,132. This scooter can be propelled by side-to-side movement and steered by tilting the handle assembly laterally. It can also be operated similarly to a conventional kick scooter. This embodiment may be a separate scooter, or it may be detachable from the two-foot support member device 10 of FIGS. 1-4.

It should be noted that any of the embodiments herein may have a brake mechanism. This may include a cable brake on the handle structure, or a friction brake activated by a rider stepping on the back of the platform or support member or other suitable braking mechanism. Many braking mechanisms are known in the art.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

The invention claimed is:

1. A personal transportation device, comprising:

a first elongated foot support member;

a first front caster wheel assembly and a first rear caster wheel assembly that are coupled to the first foot support member, the first front caster wheel assemble including a first biased-direction caster wheel;

a second elongated foot support member;

a second front caster wheel assembly and a second rear caster wheel assembly that are coupled to the second foot support member, the second front caster wheel assembly including a second biased-direction caster wheel;

a linkage assembly coupled to the first and second foot support members and configured to maintain the foot support members in a substantially parallel arrangement with one another; and a first ascending steering member;

wherein the first caster wheel and the first ascending steering member are coupled to one another and configured such that, in use, lateral movement of the first ascending member causes a turning of the first caster wheel.

2. The device of claim 1, wherein the linkage assembly is configured for releaseable locking of the first and second foot support members in a first position and a second position, and the lateral spacing between the first and second foot support members in the first position is different from that in the second position.

3. The device of claim 2, wherein the linkage assembly is configured for releaseable locking of the first and second foot support members in a third position, the spacing between the first and second foot support members in the third position being different from that in the first and second positions.

4. The device of claim 1, wherein the lateral movement of the first ascending steering member may include at least one of laterally tiltable movement and movement more perpendicular-than-parallel to a straight-forward line of direction of travel of the device.

5. The device of claim 1, wherein the first and second rear caster wheel assemblies each include a biased-direction caster wheel.

6. The device of claim 1, further comprising a second ascending steering member, and wherein the second caster wheel and the second ascending steering member are coupled to one another and configured such that, in use, lateral movement of the second ascending member causes a turning of the second caster wheel.

7. The device of claim 6, wherein the first and second ascending steering members are movable between an upright and a stowed position.

8. The device of claim 1, wherein the direction of turn of the first caster wheel corresponds to the direction of lateral movement of the first ascending steering member.

9. The device of claim 1, wherein the first and second foot support members are elongated in the direction of straight forward travel of the device.

10. A personal transportation device, comprising:

a first longitudinally elongated foot support member;

a first front caster wheel assembly and a first rear caster wheel assembly that are coupled to the first foot support member, the first front caster wheel assembly including a first biased-direction caster wheel;

a second longitudinally elongated foot support member;

a second front caster wheel assembly and a second rear caster wheel assembly that are coupled to the second foot support member, the second front caster wheel assembly including a second biased-direction caster wheel;

a linkage assembly coupled to the first and second foot support members and configured to maintain the foot support members in a coupled together arrangement during use; and a first ascending steering member;

wherein the first caster wheel and the first ascending steering member are configured such that, in use, lateral tilting of the first ascending member causes a turning of the first caster wheel.

11. The device of claim 10, further comprising a second ascending steering member, and wherein the second caster wheel and the second ascending steering member are configured such that, in use, lateral tilting of the second ascending member causes a turning of the second caster wheel.

12. The device of claim 11, wherein the first and second ascending steering members are movable between an ascending and a stowed position.

13. The device of claim 10, wherein the first and the second biased-direction caster wheels each have a tilted turning axis.

14. The device of claim 10, wherein the linkage assembly is configured to maintain the foot support members in a substantially parallel arrangement, and for releaseable locking of the first and second foot support members in a first position and a second position, the lateral spacing between the first and second foot support members in the first position being different than that in the second position.

15. The device of claim 14, wherein the linkage assembly is configured for releaseable locking of the first and second foot support members in a third position, the spacing between the first and second foot support members in the third position being different than that in the first and second positions.

16. The device of claim 10, wherein the first and second rear caster wheel assemblies each include a biased-direction caster wheel.

17. A personal transportation device, comprising:

a first longitudinally elongated foot support member;

a first front caster wheel assembly and a first rear caster wheel assembly that are coupled to the first foot support member, the first front caster wheel assembly including a first biased-direction caster wheel;

a second longitudinally elongated foot support member;

a second front caster wheel assembly and a second rear caster wheel assembly that are coupled to the second foot support member, the second front caster wheel assembly including a second biased-direction caster wheel;

a linkage assembly coupled between the first and second elongated foot support members and configured to maintain the support members in a substantially parallel arrangement with one another; and a first ascending steering member;

wherein the first caster wheel and the first ascending steering member are configured such that, in use, movement of the first ascending member causes a turning of the first caster wheel; and wherein the linkage assembly is configured for releaseable locking of the first and second foot support members in a first position and a second position, and the spacing between the first and second foot support members in the first position is different than that spacing in the second position.

18. The device of claim 17, wherein the linkage assembly is configured for releaseable locking of the first and second foot support members in a third position, the spacing between the first and second foot support members in the third position being different than that in the first and second positions.

19. The device of claim 17, further comprising a second ascending steering member, and wherein the second caster wheel and the second ascending steering member are configured such that, in use, movement of the second ascending member causes a turning of the second caster wheel.

20. The device of claim 17, wherein the first and second rear caster wheel assemblies each include a biased-direction caster wheel.

* * * * *